US010668612B2

(12) United States Patent
Saur

(10) Patent No.: US 10,668,612 B2
(45) Date of Patent: Jun. 2, 2020

(54) HAND-HELD POWER TOOL

(71) Applicant: Robert Bosch GmbH, Stuttgart (DE)

(72) Inventor: Dietmar Saur, Gomaringen (DE)

(73) Assignee: Robert Bosch GmbH, Stuttgart (DE)

( * ) Notice: Subject to any disclaimer, the term of this patent is extended or adjusted under 35 U.S.C. 154(b) by 759 days.

(21) Appl. No.: 13/787,236

(22) Filed: Mar. 6, 2013

(65) Prior Publication Data

US 2013/0240230 A1 Sep. 19, 2013

(30) Foreign Application Priority Data

Mar. 16, 2012 (DE) ..... 10 2012 204 172

(51) Int. Cl.

| | |
|---|---|
| ***B65B 21/00*** | (2006.01) |
| ***B65B 23/14*** | (2006.01) |
| ***B25F 5/00*** | (2006.01) |
| ***B25B 23/147*** | (2006.01) |
| ***B25B 23/14*** | (2006.01) |
| ***B25B 21/00*** | (2006.01) |

(52) U.S. Cl.

CPC ..... *B25F 5/001* (2013.01); *B25B 21/00* (2013.01); *B25B 23/141* (2013.01); *B25B 23/147* (2013.01)

(58) Field of Classification Search

CPC ..... B25B 23/141; B25F 5/00
USPC ..... 173/178
See application file for complete search history.

(56) References Cited

U.S. PATENT DOCUMENTS 5,657,417 A * 8/1997 Di Troia ..... B25F 5/00 173/148
5,996,707 A * 12/1999 Thome ..... B25F 5/00 173/171
6,415,875 B1 * 7/2002 Meixner ..... B24B 23/028 173/171
6,479,958 B1 * 11/2002 Thompson ..... B25F 5/00 318/430
6,607,041 B2 * 8/2003 Suzuki ..... B25B 21/02 173/11
6,843,327 B2 * 1/2005 Meixner ..... B25D 11/125 173/10
6,910,540 B2 * 6/2005 Totsu ..... B25B 23/14 173/178
7,055,620 B2 * 6/2006 Nadig ..... B25D 16/003 173/176

(Continued)

FOREIGN PATENT DOCUMENTS

GB 2 271 522 4/1994

OTHER PUBLICATIONS

Vibro-Meter Piezoelectric Accelerometer Type CE 252 http://www.vibro-meter.com/pdf/Ce252e.pdf Wayback Machine Date: Nov. 14, 2008.*

(Continued)

*Primary Examiner* — Robert F Long
*Assistant Examiner* — Patrick B Fry
(74) *Attorney, Agent, or Firm* — Norton Rose Fulbright US LLP; Gerard Messina

(57) ABSTRACT

A hand-held power tool has a tool housing in which a gear unit which is drivable by a drive motor for driving a drive shaft is situated and to which a torque clutch is assigned. On the hand-held power tool, the drive shaft is provided with a tool holder for holding an assigned insertion tool, and an acceleration sensor is provided which is designed for enabling detection of an activation of the torque clutch.

13 Claims, 3 Drawing Sheets

(56) References Cited

U.S. PATENT DOCUMENTS

| | | | | |
|---|---|---|---|---|
| 7,506,694 | B2 * | 3/2009 | Stirm | B25F 5/00 173/176 |
| 7,673,701 | B2 * | 3/2010 | Tanaka | B25B 21/00 173/4 |
| 7,703,330 | B2 * | 4/2010 | Miyazaki | B25B 21/00 173/176 |
| 8,466,641 | B2 * | 6/2013 | Kaufmann | B25F 5/001 173/176 |

OTHER PUBLICATIONS

UltraCAD Design, Inc. Microstrip Propagation Times "Slower Than We Think" Author: Douglas Brooks http://www.ultracad.com/mentor/microstrip%20propagation.pdf Copyright 2002 by UltraCAD Design, Inc. and Mentor Graphics Corporation.*

Vibro-Meter Piezoelectric Accelerometer Type CE 252 http://www.vibro-meter.com/pdf/Ce252e.pdf Wayback Machine Date: Nov. 14, 200.*

UltraCAD Design, Inc. Microstrip Propagation Times "Slower Than We Think" Author: Douglas Brooks http://www.ultracad.com/mentor/microstrip%20propagation.pdf Copyright 2002 by UltraCAD Design, Inc. and Mentor Graphics Corporatio.*

* cited by examiner

HAND-HELD POWER TOOL

BACKGROUND OF THE INVENTION

1. Field of the Invention

The present invention relates to a hand-held power tool having a tool housing in which a gear unit is situated which is drivable by a drive motor for driving a drive shaft and to which a torque clutch is assigned, the drive shaft being provided with a tool holder for holding an assigned insertion tool.

2. Description of the Related Art

A hand-held power tool designed in the form of an electric combi drill is known from published U.K. patent application document GB 2 271 522 A, having a torque clutch to which a magnetic measuring circuit is assigned, which has a magnetically conductive sleeve, situated axially movable between a Hall sensor and a permanent magnet. Activation of the torque clutch results in an axial movement of this sleeve and thus causes a change in magnetic field detectable with the aid of the Hall sensor and evaluable by an assigned control unit. In response to a detected activation of the torque clutch, this control unit may control the drive motor of the combi drill accordingly, for example switching it off.

A disadvantage in the related art is that a hysteresis in the magnetic measuring circuit may result in imprecisions in the response characteristics. In addition, the use of the magnetically conductive sleeve means that an additional mechanical component, subject to wear, is needed, which complicates the design of the hand-held power tool and results in larger dimensions.

BRIEF SUMMARY OF THE INVENTION

One object of the present invention is therefore to provide a novel hand-held power tool including a torque clutch, whose activation is detectable by structurally simple, wear-free and robust means.

This problem is solved by a hand-held power tool having a tool housing in which a gear unit is situated which is drivable by a drive motor for driving a drive shaft and to which a torque clutch is assigned, the drive shaft being provided with a tool holder for holding an assigned insertion tool. An acceleration sensor is provided which is designed for detecting an activation of the torque clutch.

A contact-free, wear-free, robust and inexpensive detection of the activation of the torque clutch, i.e., of its response or triggering, is hereby possible. In addition, the acceleration sensor may be integrated easily into existing design patterns of hand-held power tools. Furthermore, it is possible to minimize wear of the torque clutch, since its friction times or the number of friction actions may be limited.

According to one specific embodiment, the acceleration sensor is situated on the tool housing.

This means that the acceleration sensor may be simply mounted on the tool housing at an available position.

A control unit is preferably provided which is designed to evaluate an acceleration signal generated by the acceleration sensor for detecting the activation of the torque clutch.

The present invention thus enables a complex evaluation and assessment of the acceleration signal, the control unit at the same time being able to be used for motor control, in order to further simplify the structural design of the hand-held power tool.

It is preferable if the acceleration signal represents vibrations which are transmitted during operation of the hand-held power tool to the tool housing and feature an assigned average amplitude, an amplitude change of the average amplitude, detectable by the control unit, occurring upon activation of the torque clutch.

This feature ensures a safe and reliable detection of an activation of the torque clutch.

According to one specific embodiment the control unit is designed for detecting the occurring amplitude change within a period of time shorter than 1 second.

Very rapid detection of the activation of the torque clutch is hereby possible.

According to one specific embodiment, the control unit is designed for detecting the occurring amplitude change in the event of a deviation from the average amplitude of at least 0.01 g $m/s^2$.

The present invention thus enables a safe and reliable detection of the activation of the torque clutch.

It is preferable if the control unit is designed for reducing the instantaneous motor power supplied by the drive motor upon occurrence of the amplitude change.

Such a reduction in motor power may prevent unnecessary activation of the torque clutch.

According to one specific embodiment the control unit is designed for switching off the drive motor upon occurrence of the amplitude change.

Unnecessary wear of the torque clutch components when the torque clutch is activated may thus be reduced in a simple way.

It is preferable if the control unit is designed for switching the drive motor off and on periodically upon occurrence of the amplitude change.

As a result a corresponding haptic signal effect of the slipping torque clutch is intensified for the user.

According to one specific embodiment the control unit is designed for reversing the direction of rotation of the drive motor upon occurrence of the amplitude change.

For example, automatic loosening of a stuck or seized insertion tool, e.g., a drill bit, is hereby possible.

According to one specific embodiment the control unit is designed for creating a visual and/or acoustic warning signal upon occurrence of the amplitude change.

This makes it possible to signal the response of the torque clutch visually and/or audibly, in addition to the vibrations occurring at the time.

It is preferable if a setting device is provided which is designed for enabling setting of a response threshold of the control unit, above which the amplitude change is detectable.

The present invention thereby makes it easy for the response threshold to be adapted to different conditions of use of the hand-held power tool. For example, the setting device may allow selection of an appropriate preprogramming of the control unit which enables simple adaptation of its response behavior to the most varied materials to be processed by the hand-held power tool and/or to different insertion tools.

According to one specific embodiment, the acceleration sensor is positioned in the vicinity of the control unit, particularly in the vicinity of a printed circuit board assigned to the control unit.

This results in shortened electrical wiring, thereby simplifying the electrical connection of the acceleration sensor to the control unit.

According to one specific embodiment, the acceleration sensor is positioned in the vicinity of the torque clutch.

This results in an acceleration signal of greater amplitude, in particular upon activation of the torque clutch.

According to one specific embodiment, a handle is formed on the tool housing, at least the acceleration sensor being positioned in the vicinity of the handle.

The present invention thus simplifies one-handed operation of the setting device by the user and shortening of the electrical wiring at the same time.

DETAILED DESCRIPTION OF THE INVENTION

Figure 1:
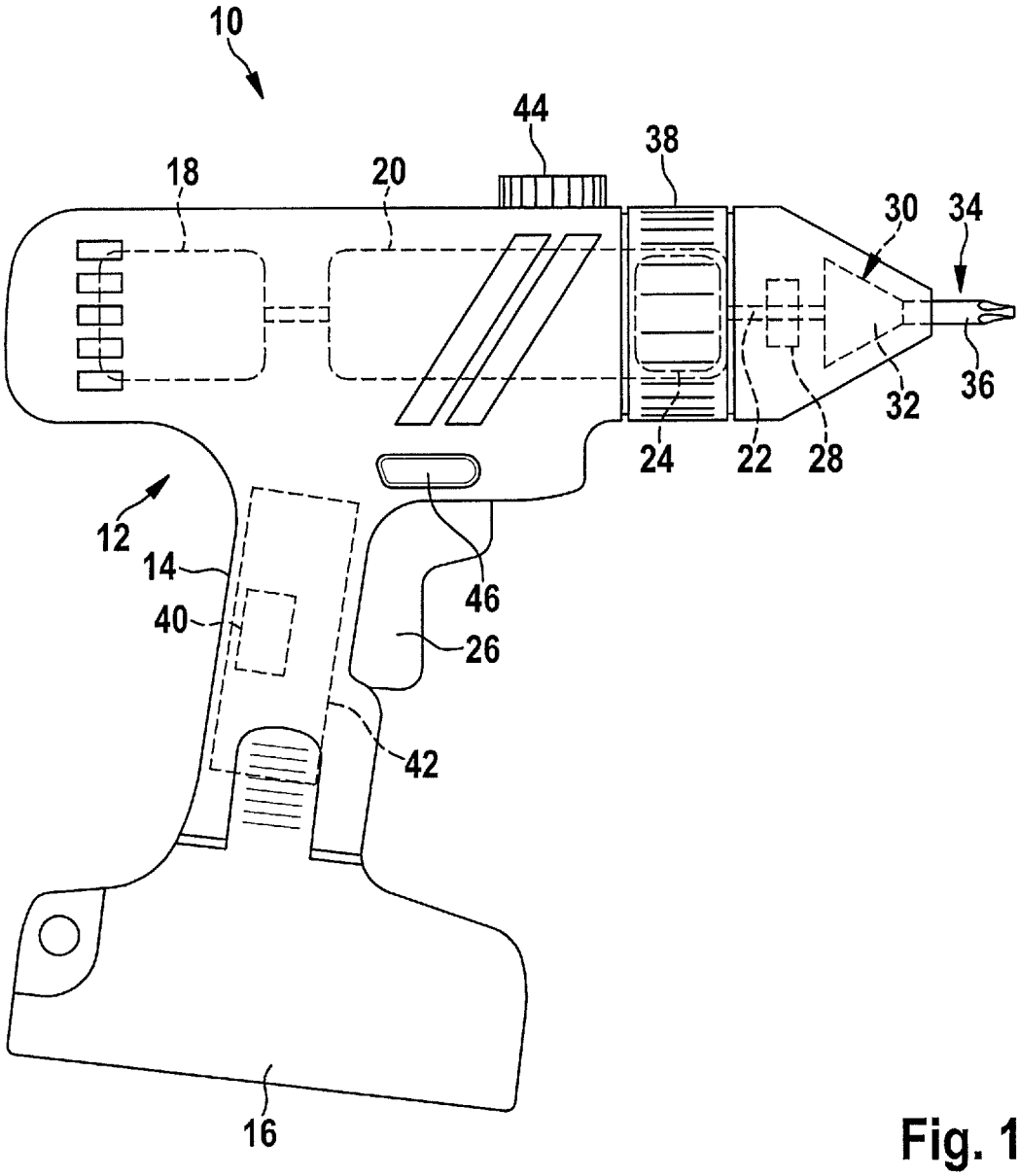
FIG. 1 shows a schematic side view of a hand-held power tool having a tool housing, in which an acceleration sensor is situated according to one specific embodiment.

FIG. 1 shows as an example a hand-held power tool 10 provided with a torque clutch 24, which as an example has a tool housing 12 including a handle 14. According to one specific embodiment, hand-held power tool 10 is mechanically and electrically connectable to a battery pack 16 for cordless power supply. In FIG. 1, hand-held power tool 10 is designed, as an example, as a battery-powered combi drill. It should be noted, however, that the present invention is not restricted to battery-powered combi drills, but may rather be used in various hand-held power tools in which a torque clutch is used, regardless of whether the hand-held power tool is operable electrically, i.e., mains-operated, or off-grid using battery pack 16, or non-electrically, e.g., a screwdriver, an impact screwdriver or a percussion drill.

According to one specific embodiment, situated in tool housing 12 are an electric drive motor 18 supplied with power from battery pack 16 and a gear unit 20, for example designed in the form of a planetary gear having different gear or planet stages. Drive motor 18 is connected via gear unit 20 to a drive shaft 22 rotatably mounted in tool housing 12 with the aid of a bearing device 28, the drive shaft being assigned a tool holder 30 for holding an insertion tool 34. Tool holder 30 is designed, for example, in the manner of a chuck 32 for holding an insertion tool 34. Insertion tool 34 is shown for the purpose of illustration as a screwdriver bit 36, but may also alternatively be, for example, a drill bit, a grinding stone, a rasp or a different tool. Tool holder 30 may be formed as an integral part of drive shaft 22 or fitted to the latter in the form of an attachment.

Electric drive motor 18 is operable, i.e., in particular switchable on or off, by a user e.g., with the aid of a manual switch 26 and may be any type of motor, for example an electronically commutated or a mechanically commutated motor. Drive motor 18 is preferably electronically controllable or adjustable in such a way that both reversing operation and settings concerning a desired speed of rotation are implementable. For example, the direction of rotation of drive motor 18 may be reversed with the aid of a manual switch 46. The mode of operation and the configuration of a suitable drive motor 18 and of an associated control unit are sufficiently well-known from the related art, so that in order to keep the description concise a more detailed description is omitted here. When hand-held power tool 10 is in operation, drive motor 18 causes gear unit 20 to rotate.

Gear unit 20 is assigned, as an example, a torque clutch 24. The latter may be of any design, including a configuration known from the related art, whose mode of operation may be based, for example, on a combination of a frictional and/or form lock between at least two bodies or components moving relative to one another within torque clutch 24. For example, torque clutch 24 may have four or more mushroom-shaped protrusions on the output side, which on the driving side at least in certain areas engage in corresponding recesses, under an adjustable spring prestress. It is, however, pointed out that configuration and mode of operation of torque clutches on the one hand are sufficiently well-known to those skilled in the art and on the other hand are not a subject matter of the present invention, so that for purposes of simplification and concision of the description a detailed description of torque clutch 24 is omitted here.

According to one specific embodiment, a mechanically operating setting device 38 is provided on tool housing 12, for example a rotatable ring, for setting a maximum mechanical torque transferable to torque clutch 24 from insertion tool 34 or drive shaft 22. If the torque transferred from insertion tool 34 or drive shaft 22 to torque clutch 24, such as is transferred if, for example, insertion tool 34 jams, exceeds the maximum torque preset on torque clutch 24, this results, for example, in a' friction of torque clutch 24, in other words the power flow between gear unit 20 and drive shaft 22 or tool holder 30 is interrupted with the aid of torque clutch 24.

According to one specific embodiment, at least one electronic acceleration sensor 40 is integrated into hand-held power tool 10, in order to ascertain the mechanical oscillations or vibrations generated during activation of torque clutch 24 when the maximum torque predefined with the aid of setting device 38 is reached. Furthermore, acceleration sensor 40 may also be used for detecting an undesirable skipping of screwdriver bit 36, provided that torque clutch 24 has not yet responded.

Acceleration sensor 40 is positioned, as an example, in the vicinity of handle 14. Alternatively, acceleration sensor 40 may also be situated in the vicinity of torque clutch 24 or in the vicinity of a printed circuit board of an electronic control unit 42 or at any other location in tool housing 12. With the aid of a further setting device 44—shown as an example at the top of FIG. 1—situated on tool housing 12, the response behavior of acceleration sensor 40 may be influenced by the user in an appropriate manner. In this context, setting device 44 may be situated in the vicinity of torque clutch 24. Alternatively, setting device 44 may also be positioned in handle 14 of tool housing 12. This makes it possible for the user to operate setting device 44 and the two manual switches 26, 46 with one hand and at the same time hold firmly and guide hand-held power tool 10 by grasping handle 14.

Figure 2:
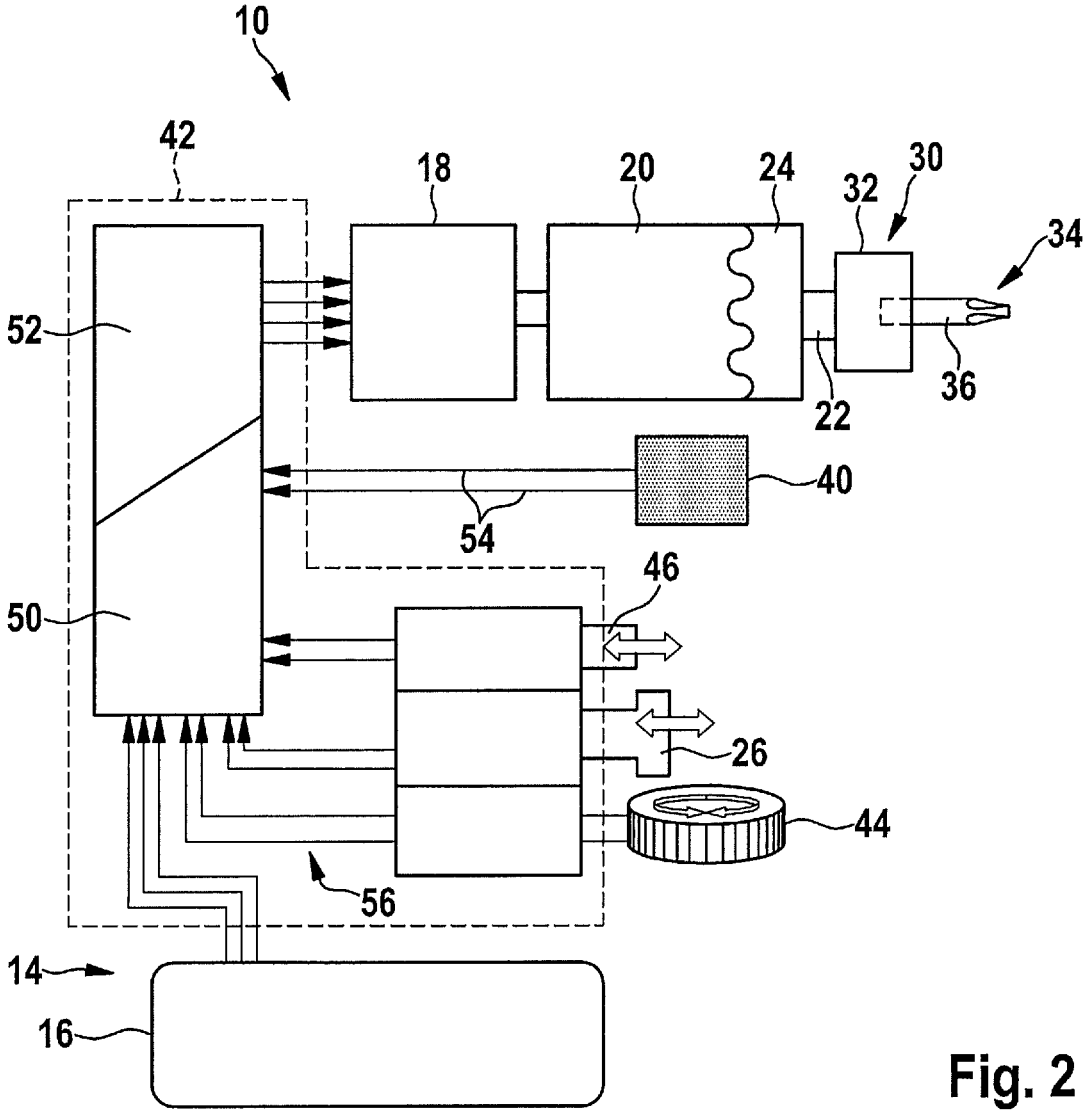
FIG. 2 shows a simplified block diagram of the hand-held power tool shown in FIG. 1.

FIG. 2 shows an illustrative block diagram of hand-held power tool 10 from FIG. 1, having manual switches 26, 46, setting device 44, control unit 42, acceleration sensor 40, drive motor 18, drive shaft 22, gear unit 20, torque clutch 24, tool holder 30 and insertion tool 34. Manual switch 26, provided for switching drive motor 18 on and off, preferably enables a stepless regulation of the speed of drive motor 18, including slow start, corresponding control signals 56 being transmitted to control unit 42 which then activates drive motor 18 accordingly. In a similar manner a user may reverse the direction of rotation of drive motor 18 with the aid of manual switch 46 as described with reference to FIG. 1.

According to one specific embodiment, control unit 42 has at least one logic circuit 50 including a downstream pulse width modulation unit (PWM unit) 52. PWM unit 52 is designed for enabling at least switching on and off, stepless motor speed regulation including slow start, and reversal of the direction of rotation of drive motor 18 under the control of logic circuit 50. For this purpose, PWM unit 52, as is known to those skilled in the art, may have electronic power switches such as power-MOSFETs or IGBTs. Logic circuit 50 may for example be configured using standard 8-bit or 16-bit microcontrollers known from the related art, so that for purposes of simplification and concision of the description a detailed description of the configuration of logic circuit 50 and PWM unit 52 is omitted here.

Connected to logic circuit 50 by way of appropriate electrical wires are, as an example, battery pack 16, manual switch 26 and manual switch 46. Furthermore, an acceleration signal 54 of acceleration sensor 40 is supplied to logic circuit 50 via suitable electrical wires.

While hand-held power tool 10 is in operation, when torque clutch 24 is activated, i.e., during response or triggering, the entire hand-held power tool 10 is subject to strong mechanical vibrations or mechanical oscillations, which are detected in real time by acceleration sensor 40 and transmitted to control unit 42 or to its logic circuit 50 for evaluation. For this purpose, logic circuit 50 is, for example, preprogrammed in such a way that within one second (1 s), at most, after acceleration signal 54 supplied by acceleration sensor 40 exceeds the average amplitude of acceleration signal 54 present during normal operation of hand-held power tool 10—in other words with torque clutch 24 not being triggered—it executes a switching operation with the aid of PWM unit 52 of control unit 42. Furthermore, acceleration sensor 40 or logic circuit 50 may be designed in such a way that even deviations of at least 0.01 g $m/s^2$ of acceleration signal 54 from this average amplitude of acceleration signal 54 are reliably detectable during normal operation of hand-held power tool 10. The average amplitude present during normal operation of hand-held power tool 10 may be ascertained, for example by appropriate measurements during manufacture of hand-held power tool 10 or alternatively, for example, by an auto-calibration to be carried out at any startup and internally stored in control unit 42, for example in an appropriate memory unit.

A possible switching operation of control unit 42 or of PWM unit 52 is for example a shut-down of drive motor 18, at least temporarily. Alternatively or additionally, an at least temporary reduction in the power of drive motor 18 and/or a reversal of the direction of rotation of drive motor 18 may take place. It is furthermore possible to switch drive motor 18 periodically off, at least temporarily, and then switch it on again. The described switching operations may, for example, enable renewed engagement of torque clutch 24 and thus deactivate the latter, so that an otherwise typical, multiple friction or skipping of the mechanical coupling components inside torque clutch 24 upon response or triggering is avoided. In addition acoustic and/or visual signals may also be output for the user with the aid of control unit 42 upon activation of torque clutch 24.

According to one specific embodiment, setting device 44, designed for influencing the response behavior of acceleration sensor 40, is used for stepless setting of a response threshold of control unit 42 or of its logic circuit 50 above which the activation of torque clutch 24 is detected as such. For example, setting device 44 may be used to predefine a period of time within which the amplitude of acceleration signal 54 must deviate from the average amplitude, or alternatively a minimum deviation value may be predefined which must be exceeded, in order to detect the activation of torque clutch 24.

Figure 3:
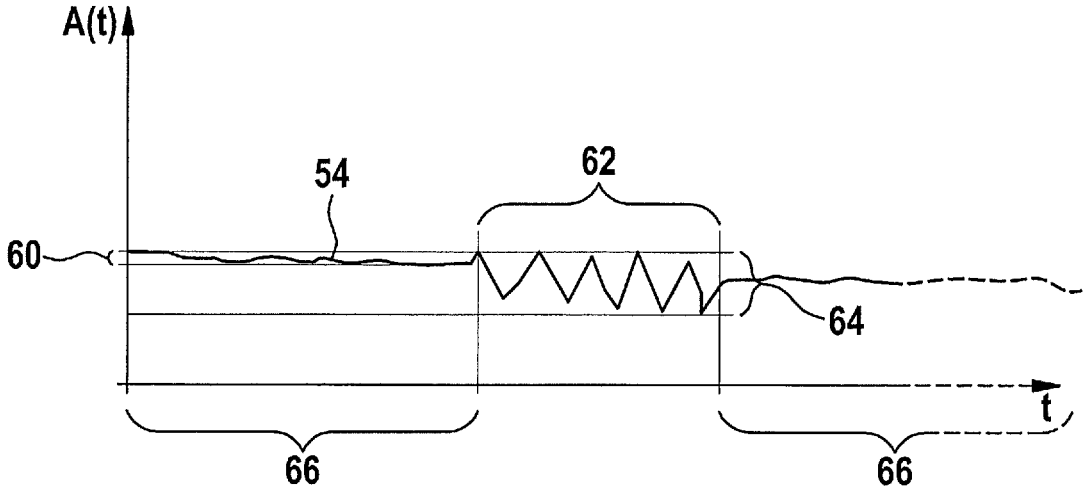
FIG. 3 shows a graph of an exemplary curve over time of an acceleration signal detectable by the acceleration sensor shown in FIGS. 1 and 2.

FIG. 3 shows as an example a curve over time of the acceleration signal 54 from FIG. 2, detected by acceleration sensor 42 from FIGS. 1 and 2 and supplied to control unit 42 from FIGS. 1 and 2, both during normal operation of hand-held power tool 10 from FIGS. 1 and 2 and with triggered torque clutch 24 from FIGS. 1 and 2. In this representation, acceleration values A(t) of acceleration signal 54 detected by acceleration sensor 42 are plotted on the ordinate, while the abscissa shows time t.

During an exemplary normal operation 66 of hand-held power tool 10 from FIGS. 1 and 2, i.e., with torque clutch 24 not triggered, acceleration signal 54 has an illustrative average amplitude 60. During this normal operation 66, no significant vibrations or mechanical oscillations occur on torque clutch 24 or on tool housing 12 from FIG. 1, so that corresponding deviations from average amplitude 60 are comparatively small. If, however, there is a response of torque clutch 24, because a torque set by the user and maximally processable by torque clutch 24 has been temporarily exceeded, an assigned amplitude change 64 of acceleration signal 54 or comparatively large deviations from average amplitude 60 result within an assigned response interval 62 of torque clutch 24 due to the mechanical vibrations acting on acceleration sensor 40, the amplitude change and the deviations being evaluable with the aid of control unit 42 from FIGS. 1 and 2, or its logic circuit 50, as described above.

What is claimed is:

1. A hand-held power tool, comprising:

a tool housing;

a drive shaft provided with a tool holder for holding an assigned insertion tool;

a gear unit provided in the tool housing, wherein the gear unit is drivable by a drive motor for driving the drive shaft;

a torque clutch assigned to the drive shaft;

a manually operable setting device configured to set a predefined maximum torque transferable from the gear unit to the tool holder, wherein the power tool is designed so that, when the predefined maximum torque is reached, the torque clutch is activated thereby generating at least one of oscillations or vibrations;

an acceleration sensor configured to detect the at least one of oscillations or vibrations and output an acceleration signal that represents vibrations transmitted to the tool housing and that has an assigned average amplitude from which the acceleration signal varies in response to the activation of the torque clutch; and a control unit that is communicatively coupled to the acceleration sensor to obtain the acceleration signal from the acceleration sensor and that is configured to detect the activation of the torque clutch by identifying the varying of the acceleration signal that the control unit obtains from the acceleration sensor.

2. The hand-held power tool as recited in claim 1, wherein the control unit is configured to detect the occurring amplitude change within a period of time which is shorter than 1 second.

3. The hand-held power tool as recited in claim 1, wherein the control unit is configured to detect the occurring amplitude change upon a deviation of at least 0.01 g*($m/s^2$) from the average amplitude.

4. The hand-held power tool as recited in claim 1, wherein the control unit is configured to reduce a motor power supplied by the drive motor upon occurrence of the amplitude change.

5. The hand-held power tool as recited in claim 1, wherein the control unit is configured to turn off the drive motor upon occurrence of the amplitude change.

6. The hand-held power tool as recited in claim 1, wherein the control unit is configured to periodically switch the drive motor off and on upon occurrence of the amplitude change.

7. The hand-held power tool as recited in claim 1, wherein the control unit is configured to reverse a direction of rotation of the drive motor upon occurrence of the amplitude change.

8. The hand-held power tool as recited in claim 1, wherein the control unit is configured to generate at least one of a visual and acoustic warning signal upon occurrence of the amplitude change.

9. The hand-held power tool as recited in claim 1, further comprising:

a further setting device which enables setting of a response threshold of the control unit, wherein the amplitude change is detectable above the response threshold.

10. The hand-held power tool as recited in claim 1, wherein the acceleration sensor is positioned in the vicinity of a printed circuit board assigned to the control unit.

11. The hand-held power tool as recited in claim 1, wherein the acceleration sensor is positioned in the vicinity of the torque clutch.

12. The hand-held power tool as recited in claim 1, wherein a handle is formed on the tool housing, and wherein at least the acceleration sensor is positioned in the vicinity of the handle.

13. The hand-held power tool as recited in claim 1, wherein the acceleration sensor is situated on the tool housing.

* * * * *